US011193300B2

(12) United States Patent
Thomas et al.

(10) Patent No.: US 11,193,300 B2
(45) Date of Patent: Dec. 7, 2021

(54) CONTAINMENT AIRLOCK COMPRISING AN ARTICULATED, COLLAPSIBLE SELF-SUPPORTING FRAME

(71) Applicant: Orano Cycle, Chatillon (FR)

(72) Inventors: Pascal Thomas, Gonneville (FR); Christian Lemarquand, Brix (FR); Guillaume Garnier, Cherbourg (FR)

(73) Assignee: ORANO CYCLE, Chatillon (FR)

( * ) Notice: Subject to any disclaimer, the term of this patent is extended or adjusted under 35 U.S.C. 154(b) by 0 days.

(21) Appl. No.: 16/611,319

(22) PCT Filed: May 7, 2018

(86) PCT No.: PCT/FR2018/051143
§ 371 (c)(1),
(2) Date: Nov. 6, 2019

(87) PCT Pub. No.: WO2018/206893
PCT Pub. Date: Nov. 15, 2018

(65) Prior Publication Data

US 2020/0165838 A1 May 28, 2020

(30) Foreign Application Priority Data

May 10, 2017 (FR) ..... 1754108

(51) Int. Cl.
*E04H 15/48* (2006.01)
*E04H 1/12* (2006.01)
(Continued)

(52) U.S. Cl.
CPC ..... *E04H 15/48* (2013.01); *E04H 1/1277* (2013.01); *E04B 1/3441* (2013.01); *E04H 15/42* (2013.01); *E04H 15/58* (2013.01); *G21F 7/00* (2013.01)

(58) Field of Classification Search
CPC ..... E04H 15/48; E04H 15/52
See application file for complete search history.

(56) References Cited

U.S. PATENT DOCUMENTS 1,509,881 A * 9/1924 Severin ..... E04H 15/48 135/143
3,199,518 A * 8/1965 Glidewell ..... E04H 15/48 135/144

(Continued)

FOREIGN PATENT DOCUMENTS

EP 0679353 A1 11/1995
FR 2525802 A1 10/1983

(Continued)

OTHER PUBLICATIONS

Preliminary French Search Report for Application No. FR 1754108 dated Jan. 11, 2018.

(Continued)

*Primary Examiner* — Noah Chandler Hawk
(74) *Attorney, Agent, or Firm* — Pearne & Gordon LLP

(57) ABSTRACT

A containment airlock, in particular an airlock for intervention on a site likely to be contaminated with radiation, asbestos and biological and/or chemical agents. The containment airlock includes a self-supporting frame and a flexible containment shell. The shell is configured to be assembled with the frame. The frame is articulated so as to be extensible between a folded storage position and an extended intervention position. The frame includes articulated reinforcement rods. The articulated reinforcement rods include rigid segments and at least one intermediate articulation connecting the segments.

17 Claims, 7 Drawing Sheets

(51) Int. Cl.

| | |
|---|---|
| *E04B 1/344* | (2006.01) |
| *E04H 15/42* | (2006.01) |
| *E04H 15/58* | (2006.01) |
| *G21F 7/00* | (2006.01) |

(56) References Cited

U.S. PATENT DOCUMENTS 4,077,418 A * 3/1978 Cohen ..... E04H 15/48 135/118
4,186,507 A * 2/1980 Stinnett ..... A01M 31/00 43/1
4,706,551 A * 11/1987 Schofield ..... B08B 15/026 454/66
5,771,651 A * 6/1998 Shiina ..... E04H 15/48 52/641
5,884,647 A * 3/1999 Dwek ..... E04H 15/52 135/144
6,125,483 A * 10/2000 Stroud ..... A47D 13/063 135/128
6,772,458 B2 * 8/2004 Ellen ..... A47C 21/08 135/143
7,134,444 B2 * 11/2006 Mintie ..... B08B 15/00 135/131
7,152,614 B2 * 12/2006 Kalnay ..... E04B 1/34305 135/128
7,290,378 B2 * 11/2007 Kalnay ..... E04B 1/34305 135/126
9,028,016 B2 * 5/2015 Glenn, Jr. ..... A47B 43/00 312/257.1
2004/0071587 A1 4/2004 McAtarian
2009/0308424 A1 * 12/2009 Danziger ..... E04H 15/48 135/141
2012/0325279 A1 * 12/2012 Munoz ..... B08B 15/026 135/93
2013/0206197 A1 * 8/2013 Hotes ..... E04H 15/60 135/96

FOREIGN PATENT DOCUMENTS

| | | | |
|---|---|---|---|
| FR | 2933527 | A1 | 1/2010 |
| FR | 3025651 | A1 | 3/2016 |
| WO | 98/29696 | A1 | 7/1998 |
| WO | 2012/025453 | A1 | 3/2012 |
| WO | 2014019022 | A1 | 2/2014 |

OTHER PUBLICATIONS

International Search Report for PCT/FR2018/051143 dated Jul. 18, 2019.
Written Opinioin for PCT/FR2018/051143 dated Jul. 18, 2019.

* cited by examiner

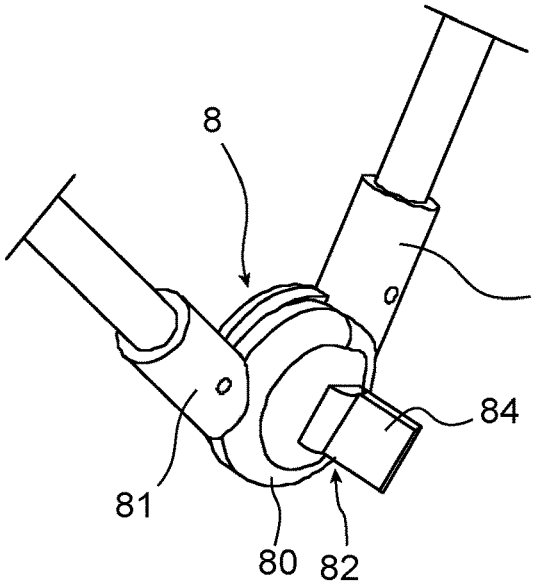
FIG. 5
FIG. 6
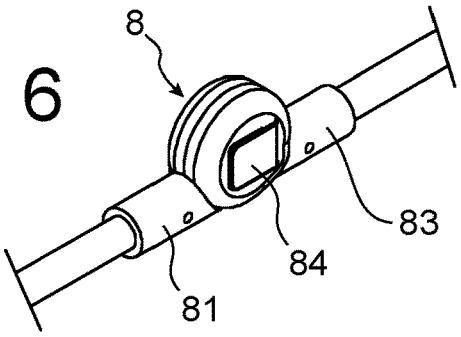
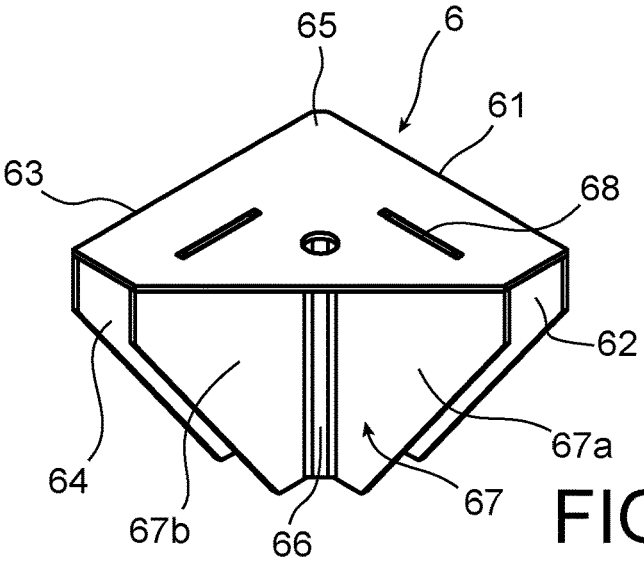
FIG. 7

CONTAINMENT AIRLOCK COMPRISING AN ARTICULATED, COLLAPSIBLE SELF-SUPPORTING FRAME

CROSS-REFERENCE TO RELATED APPLICATIONS

This is a National Stage application of PCT international application PCT/FR2018/051143, filed on May 7, 2018, which claims the priority of French Patent Application No. 17 54108, filed May 10, 2017, both of which are incorporated herein by reference in their entireties.

TECHNICAL FIELD

The invention relates to the field of containment airlocks, particularly to work airlocks on a site on which radiological, asbestos, biological and/or chemical contamination may occur. The containment airlock has a rigid self-supporting frame.

STATE OF PRIOR ART

Containment airlocks with a rigid frame are known for doing work on nuclear sites. These containment airlocks are used in particular for work targeted on a nuclear facility such as a reactor or a workshop in a fuel cycle installation, to assure containment during isolated operations for which there is a risk of dissemination of radioactive material. This work may for example include inspection, maintenance, dismantling, conditioning or transfer operations on contaminated equipment.

The rigid frame is formed from metal tubes engaged on each other. It is covered by a shell that is leak tight to radioactive dust. This shell is generally manufactured from layers made of a vinyl material fixed onto the frame and to each other by adhesive.

Installation of the containment airlock and cleaning and then disassembly after the work are often difficult and time consuming. Consequently, they expose operators to a risk of contamination for a longer period. The result is disadvantages in terms of safety, cost and work time that can be significant over the duration of a work site.

Furthermore, the containment quality provided by these known shells can be significantly improved, particularly due to separation of the adhesives. Periodic actions are performed to recondition airlocks.

Finally, and generally, existing containment airlocks include the rigid frame of the airlock that therefore has to be decontaminated for reuse and cannot be considered as waste, this operation possibly being difficult and tedious.

PRESENTATION OF THE INVENTION

The invention is aimed at at least partially solving problems encountered in solutions according to prior art.

In this respect, the invention relates to a containment airlock, particularly a work airlock on a site on which radiological, asbestos, biological and/or chemical contamination may occur.

One of the purposes is an airlock that can be quickly installed and removed.

Another purpose is to have an airlock with standard dimensions that can easily be assembled to each other when a larger containment zone is necessary to do the work.

Yet another purpose of the invention is to limit attachments by adhesives.

Finally, another purpose of the invention is to limit or even avoid exposing the airlock support structure to the risk of contamination induced by operations that take place outside the airlock, or preferably inside the airlock.

Thus, the containment airlock comprises a self-supporting frame and a flexible containment shell. The frame is articulated so that it is expandable from a collapsed storage position and an extended work position. The flexible containment shell is configured to be removably assembled to the frame.

According to the invention, the frame comprises a first collapsible plane frame, a second collapsible plane frame and rigid single-piece reinforcing rods that connect the first plane frame to the second plane frame.

The first plane frame and the second plane frame each contain vertices of the frame and articulated reinforcing rods that connect the vertices of the first plane frame to each other and the vertices of the second plane frame to each other. Each of the articulated reinforcing rods comprises a first rigid segment, a second rigid segment and at least one intermediate articulation connecting the first segment to the second segment.

The rigid single-piece reinforcing rods connect the vertices of the first plane frame to the vertices of the second plane frame. The first plane frame and the second plane frame are located at opposite longitudinal ends of the rigid single-piece reinforcing rods.

The first plane frame and the second plane frame are configured such that segments of the articulated reinforcing rods move towards the rigid reinforcing rods when the frame moves from its extended position to its collapsed position, and such that segments of the articulated reinforcing rods move away from the rigid reinforcing rods when the frame moves from its collapsed position to its extended position.

Installation of the containment airlock and disassembly of the containment airlock according to the invention are faster and easier, while enabling relative modularity in the shape and size of the containment zone formed. The containment airlock thus reduces exposure of an operator to a risk of radiological, asbestos, chemical and/or biological contamination. The containment airlock also has a very satisfactory mechanical strength, while being fast and easy to install and disassemble.

The invention may optionally include one or more of the following characteristics, that may or may not be combined with each other.

Advantageously, the intermediate articulation of each articulated reinforcing rod is configured to rotate and to guide a first segment of the reinforcing rod relative to a second segment of the reinforcing rod, towards the inside of the frame when the frame moves from its extended position to its collapsed position, or towards the outside of the frame when the frame moves from its collapsed position to its extended position.

Preferably, the intermediate articulation is configured to rotate and guide the first segment about a pivot link.

According to one particular embodiment, the intermediate articulation of each articulated reinforcing rod is located approximately in the middle of the reinforcing rod.

According to one advantageous embodiment, the intermediate articulation of at least one of the articulated reinforcing rods comprises a locking element configured to lock the position of a first segment of the reinforcing rod relative to the position of a second segment of the reinforcing rod.

Preferably, the intermediate articulation comprises a clevis and the locking element comprises a latch that is free to move relative to the clevis between a locked position and an unlocked position of the articulation.

According to another particular embodiment, the frame comprises vertices, and articulated reinforcing rods connecting the vertices. At least one of the vertices is configured to rotate and to guide the first segment of a first reinforcing rod relative to this vertex, towards the inside of the frame when the frame moves from its extended position to its collapsed position, or towards the outside of the frame when the frame moves from its collapsed position to its extended position.

Preferably, this vertex is configured to rotate and to guide the first segment about a pivot link, particularly in a vertical plane.

Advantageously, at least one of the vertices comprises a housing to partially house the first segment, the housing being at least partially delimited by walls configured to make the first segment pivot relative to this vertex, when the frame moves from its extended position to its collapsed position, or from its collapsed position to its extended position.

According to one particular embodiment, at least one of the vertices comprises an internal end piece configured to engage at least one segment of a reinforcing rod connected to this vertex, by cooperation of shapes.

According to another particular embodiment, at least one of the vertices comprises at least one first side wall, a second side wall, a horizontal wall and an internal wall. The first side wall, the second side wall and the horizontal wall are orthogonal in pairs and intersect each other. The internal wall extends perpendicular to the horizontal wall. Each of the lateral walls has an approximately triangular external surface.

The internal wall comprises a first segment that extends parallel to the first lateral wall and a second segment that extends parallel to the second lateral wall. Each of the first segment and the second segment has an approximately triangular external surface.

The internal wall, and particularly the first segment, and the first side wall delimit a first internal housing for an articulated reinforcing rod segment. The internal wall, and particularly the second segment, delimits a second internal housing with the second side wall, for an articulated reinforcing rod segment. The internal wall and the side walls delimit a central conduit for one of the rigid single-piece reinforcing rods.

According to one advantageous embodiment, at least one of the vertices is connected to a segment of a second articulated reinforcing rod. This vertex is configured to allow rotation and to guide the segment of the second rod relative to this vertex, bringing it closer to the first segment of the first rod when the frame moves from its extended position to its collapsed position, or moving it away from the first segment of the first rod when the frame moves from its collapsed position to its extended position.

Preferably, at least one of the vertices is also connected to a third reinforcing rod while being rigidly connected to the third reinforcing rod when the frame moves from its collapsed position to its extended position or from its extended position to its collapsed position.

Advantageously, the first plane frame is a horizontal plane support frame, the second plane frame is a horizontal plane top frame, the rigid single-piece reinforcing rods are the frame uprights.

Preferably, the uprights are particularly vertical uprights that are orthogonal to the first plane frame and to the second plane frame.

Advantageously, each intermediate articulation of the articulated reinforcing rods of the second plane frame comprises a locking element configured to lock the position of a first segment of the reinforcing rod relative to the position of a second segment of the reinforcing rod.

Preferably, the articulated reinforcing rods of the first plane frame do not have locking elements.

According to one advantageous embodiment, the containment airlock is generally parallelepiped in shape, at least when the frame is in the extended position.

Preferably, the containment airlock is generally parallelepiped in shape when the frame is in the collapsed position.

Advantageously, the shell is configured to be assembled to the frame such that the frame is outside the shell.

According to another particular embodiment, the flexible shell is made in a single piece by welded plastic panels.

Advantageously, the shell is made of a dust tight material.

Preferably, the plastic material comprises cross-linked polyurethane and/or a vinyl polymer, such as polyvinyl chloride.

Advantageously, the airlock comprises hooks to removably attach the shell to the frame.

Preferably, the flexible shell comprises eyelets, preferably made of plastic, to which the hooks are attached.

According to one particular embodiment, the containment airlock is equipped with depressurisation means configured to create a vacuum inside the airlock, relative to the air pressure outside the airlock.

Preferably, these depressurisation means are used at the end of the work when the flexible shell is contaminated, to draw out air contained in the shell so as to reduce its volume and make it more compact ready to be scrapped. This operation is then done without any direct action by the operators on the shell, avoiding decontamination, disassembly and folding of this shell by the operators, thus limiting risks of contamination for operators and the duration of the work.

Preferably, the depressurisation means comprise an extraction fan, a filter and/or connection sleeves.

The invention also relates to a containment assembly comprising a plurality of containment airlocks as defined above that are placed adjacent to each other and connected together to form a containment zone. This containment zone can be used in the case of radiological, asbestos, biological and/or chemical contamination.

BRIEF DESCRIPTION OF THE DRAWINGS

This invention will be better understood after reading the description of example embodiments, given purely for information and in no way limitative, with reference to the appended drawings on which:

FIG. 5 is a partial diagrammatic perspective representation of an intermediate articulation of the frame, in the unlocked position;

FIG. 6 is a partial diagrammatic perspective representation of the intermediate articulation, in the locked position;

FIG. 7 is a partial diagrammatic representation of a vertex of the frame of the containment airlock;

DETAILED PRESENTATION OF PARTICULAR EMBODIMENTS

Figure 1:
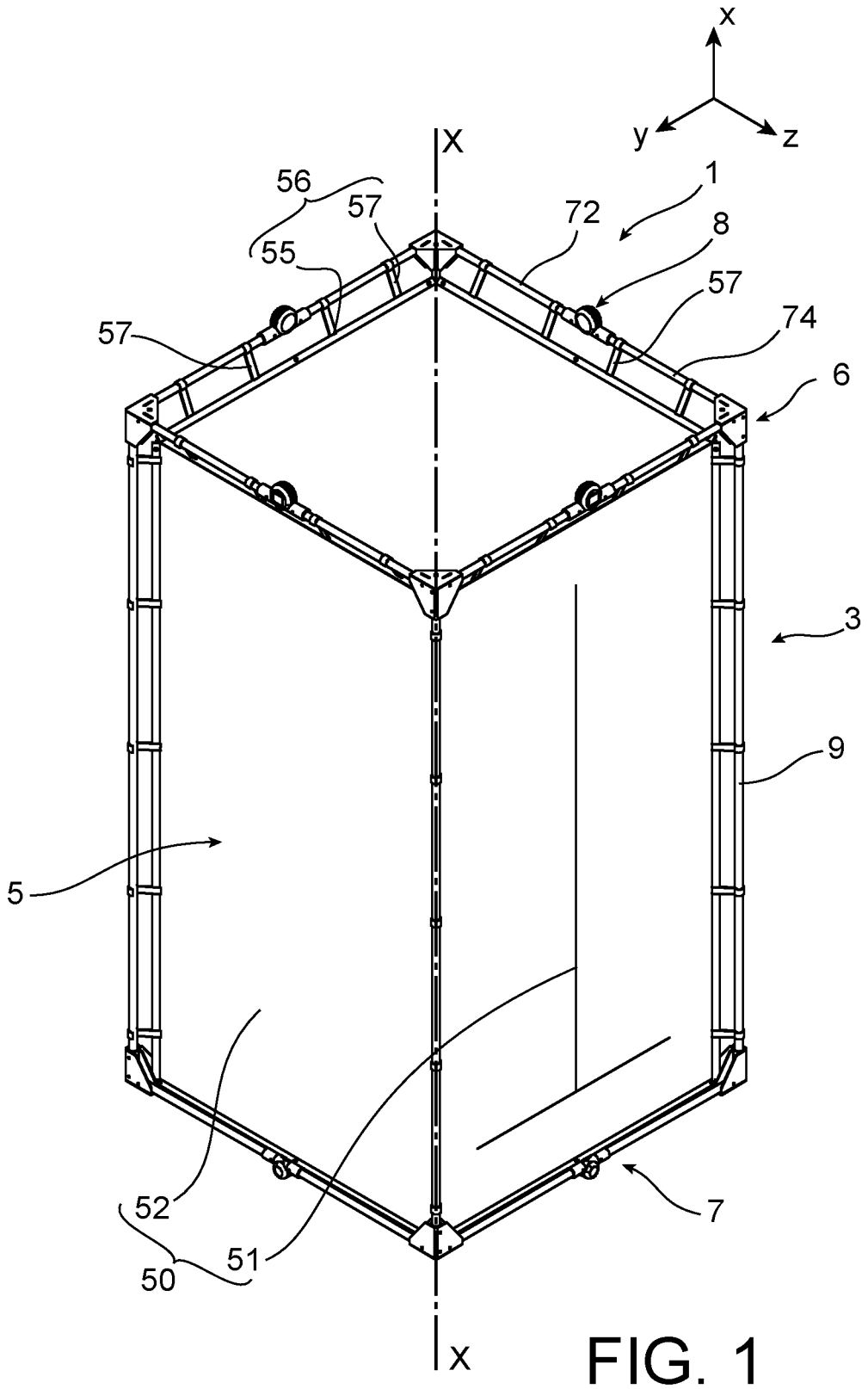
FIG. 1 is a partial diagrammatic perspective representation of a first preferred embodiment of a containment airlock.

FIG. 1 represents a containment airlock 1. The containment airlock 1 is a containment airlock for working on a site on which radiological, asbestos, biological and/or chemical contamination may occur. For example, it is used for work targeted in particular on a nuclear facility, reactor or a workshop in a fuel cycle installation, to assure containment during isolated operations for which there is a risk of dissemination of radioactive material. This work may for example include inspection, maintenance, dismantling, conditioning or transfer operations on contaminated equipment.

Confined areas typically comprise a changing area and a work area, and possibly an equipment entry-exit area.

The containment zone 1 comprises a frame 3, a flexible shell 5 and means of depressurising the containment airlock 1 (not shown). The containment airlock 1 can be collapsed, which makes it easier to transport, install and uninstall, and put into storage. Its shape is generally a rectangular parallelepiped, when it is extended and ready for use on a site that might be contaminated. It also has a generally rectangular parallelepiped shape when it is collapsed.

The containment airlock 1 extends from bottom to top along an X-X longitudinal axis that is an axis of symmetry of the containment airlock. It also extends from front to back along a depth axis Y-Y and from left to right along a transverse axis Z-Z. The longitudinal axis X-X, the depth axis Y-Y and the transverse axis Z-Z jointly form an orthonormal coordinate system.

The shell 5 comprises a flexible fabric 50 and attachments 56 to attach the flexible fabric 50 to the frame 3. The shell 5 can be folded between an extended position corresponding to the extended position of the airlock that can be seen on FIG. 1, and a collapsed storage position corresponding to the collapsed position of the containment airlock 1, that can be seen on FIG. 4. It is designed to either remain attached to the frame 3 when the frame 3 moves from its extended position to its collapsed position, or to be detached from the frame 3 after use, particularly if it is contaminated.

The general shape of the flexible fabric 50 is a rectangular parallelepiped. It is designed to be attached to the frame 3, inside the frame 3. In particular, this arrangement has the advantage of being easy to disassemble the airlock 1 from the exterior, thus limiting the risk of exposure for operators working on disassembly.

The flexible fabric 50 is made in a single piece by flexible welded plastic panels 52. It comprises at least one opening 51 made in one of the panels 52, so that a person or equipment can enter and/or leave the containment airlock 1.

The panels 52 are made from a material adapted to the environment at risk, generally a plastic material, and particular a dust-tight material. For example, this plastic material comprises cross-linked polyurethane and/or a vinyl polymer, such as polyvinyl chloride.

The flexible fabric 50 is made so that it is possible to install conduits between the interior and the exterior of the containment airlock 1, for example by using a tool to cut the fabric. These conduits can be used to position the depressurisation means that depressurise the airlock, or to introduce the electric cables necessary to supply power for tools to work inside the containment airlock 1.

Each of the fasteners 56 comprises a hook 57 and an eyelet 55 to retain the hook. Each hook 57 is configured to removably assemble the flexible fabric 50 to the frame 3. The eyelet 55, the role of which is to prevent tearing of the flexible fabric, is preferably made of a plastic material.

The depressurisation means of the containment airlock 1 (not shown) are configured to create a negative pressure inside the airlock 1 relative to the air pressure around the airlock 1, to limit leaks and therefore the dispersion of contaminating materials.

They comprise a suction pump to draw out air from inside the airlock, a filter and connecting conduits. The air suction pump has a fluid connection to a filter, so that the filter can filter radioactive or other dust present inside the containment airlock 1.

After the work and after all openings in the shell 5 have been closed and the hooks 57 have been detached from the frame 3, the depressurisation means have another function that is to draw out air contained in the flexible shell 5 to reduce its volume, to compact it ready for treatment as waste.

The frame 3 is described with reference to FIGS. 2 to 4. It comprises vertices 6, articulated reinforcing rods 7 and single-piece reinforcing rods 9. The articulated reinforcing rods 7 and the rigid single-piece rods 9 mechanically connect the vertices 6 to each other.

The frame 3 comprises four lower articulated reinforcing rods 7*a*, 7*b*, 7*c*, 7*d* that connect four lower vertices 6*a*, 6*b*, 6*c*, 6*d* to each other. It comprises four upper articulated reinforcing rods 7*e*, 7*f*, 7*g*, 7*h* that connect the four upper vertices 6*e*, 6*f*, 6*g*, 6*h* to each other. It comprises four single-piece rods 9*a*, 9*b*, 9*c*, 9*d* that connect the lower vertices 6*a*, 6*b*, 6*c*, 6*d* and the upper vertices 6*e*, 6*f*, 6*g*, 6*h* respectively, to each other.

Pairs of articulated reinforcing rods 7 have an identical structure. Pairs of single-piece reinforcing rods 9 have an identical structure. Pairs of vertices 6 have an identical structure.

The articulated reinforcing rods 7, the single-piece reinforcing rods 9 and the vertices 6 form a rigid reinforcement when the frame 3 is in the extended work position. In other words, the frame 3 is self-supporting.

The frame 3 can support the shell 5. It is articulated so that it can be expanded between a collapsed storage position and an expanded work position. The general shape of the frame 3 is a rectangular parallelepiped that is represented on FIG. 2, when it is in the extended position. Its general shape is a rectangular parallelepiped that is represented on FIG. 4, when it is in the collapsed position.

The frame 3 comprises a first collapsible lower plane frame 32, a second collapsible upper plane frame 34, and rigid single-piece reinforcing rods 9 that connect the first plane frame 32 to the second plane frame 34. The geometry of the plane frames 32 and 34 is generally identical for a rectangular parallelepiped shaped frame.

The first lower plane frame 32 comprises the four lower articulated reinforcing rods 7*a*, 7*b*, 7*c*, 7*d* that connect the four lower vertices 6*a*, 6*b*, 6*c*, 6*d* to each other. The first lower plane frame 32 is a horizontal plane support frame for the frame 3. It is in the shape of a rectangle or square in the extended position. The lower vertices 6*a*, 6*b*, 6*c*, 6*d* form a square that is smaller in the collapsed position.

The first lower articulated reinforcing rod 7*a* extends from the first lower vertex 6*a* to the second lower vertex 6*b*. The second lower articulated reinforcing rod 7*b* extends from the second lower vertex 6*b* to the third lower vertex 6*c*. The third lower articulated reinforcing rod 7*c* extends from the third lower vertex 6*c* to the fourth lower vertex 6*d*. The fourth lower articulated reinforcing rod 7*d* extends from the fourth lower vertex 6*d* to the first lower vertex 6*a*.

The second upper plane frame 34 comprises the four upper articulated reinforcing rods 7*e*, 7*f*, 7*g*, 7*h* that connect the four upper vertices 6*e*, 6*f*, 6*g*, 6*h* to each other. The second upper plane frame 34 is a horizontal plane top frame for the frame 3. It is in the shape of a rectangle or square in the extended position. The upper vertices 6*e*, 6*f*, 6*g*, 6*h* form a square that is smaller in the collapsed position.

The first upper articulated reinforcing rod 7*e* extends from the first upper vertex 6*e* to the second upper vertex 6*f*. The second upper articulated reinforcing rod 7*f* extends from the second upper vertex 6*f* to the third upper vertex 6*g*. The third upper articulated reinforcing rod 7*g* extends from the third upper vertex 6*g* to the fourth upper vertex 6*h*. The fourth upper articulated reinforcing rod 7*h* extends from the fourth upper vertex 6*h* to the first upper vertex 6*e*.

The rigid single-piece reinforcing rods 9 form vertical uprights for the frame. The first upright 9*a* extends from the first lower vertex 6*a* to the first upper vertex 6*e*. The second upright 9*b* extends from the second lower vertex 6*b* to the second upper vertex 6*f*. The third upright 9*c* extends from the third lower vertex 6*c* to the third upper vertex 6*g*. The fourth upright 9*d* extends from the fourth lower vertex 6*d* to the second upper vertex 6*h*.

With reference to FIG. 1, each of the articulated reinforcing rods 7 comprises a first segment 72, a second segment 74 and an intermediate articulation 8. In FIG. 2, the intermediate articulations 8 are referenced from a to h depending on the articulated reinforcing rod 7 of which they form part. In FIG. 3, the first segments 72 are referenced from a to h depending on the articulated rod 7 of which they form part. The second segments 74 are referenced from a to h depending on the articulated reinforcing rod 7 of which they form part.

The first segment 72 and the second segment 74 of each articulated reinforcing rod 7 are each in the form of a hollow tube made of a metallic material, typically steel. This hollow tube has a circular cross-section in the embodiment shown. The first segment 72 and the second segment 74 are rigid. The first segment 72 and the second segment 74 are each connected to a different vertex 6.

The intermediate articulation 8 mechanically connects the first segment 72 and the second segment 74 of the articulated reinforcing rod 7 to each other. This intermediate articulation 8 is located approximately in the middle of the articulated reinforcing rod 7. It comprises a clevis 80 and a locking element 82.

It is configured to rotate and to guide the first segment 72 and the second segment 74 inwards into the frame 3 in a vertical plane, when the frame 3 moves from its extended position to its collapsed position. In particular, it is configured to move the first segment 72 towards the second segment 74, when the frame 3 moves from its extended position to its collapsed position.

It is also configured to rotate and to guide the first segment 72 and the second segment 74 outwards from the frame 3 in the vertical plane, when the frame 3 moves from its collapsed position to its extended position. In particular, it is configured to move the first segment 72 away from the second segment 74, when the frame 3 moves from its collapsed position to its extended position.

With reference to FIGS. 5 and 6, the clevis 80 comprises a first reception end piece 81 and a second reception end piece 83 that is located at one end of the clevis 80 opposite that of the first end piece 81.

The clevis 80 is configured to rotate and guide the first segment 72 relative to the second segment 74 about a pivot link. It guides them such that the first segment 72 and the second segment 74 form a "V" with a variable opening when the frame is collapsed. It is designed to guide the articulated reinforcing rod 7 in the plane of one of the side faces of the frame 3.

The clevis 80 is configured to move towards the middle of the uprights 9 along the height direction X-X when the frame 3 is collapsed. It is configured to move towards the corresponding vertices along the transverse direction Y-Y and/or the depth direction Z-Z, bringing the vertices towards each other.

The first reception end piece 81 will house a longitudinal end of the first segment 72 of the articulated rod. It will be fixed to the first segment 72. The second end piece 83 will house a longitudinal end of the second segment 74 of the articulated rod. It will be fixed to the second segment 74.

The locking element 82 comprises a latch 84 that is free to move relative to the clevis 80 between a locked position of the articulation 8 and an unlocked position of the articulation 8. The locking element 82 is configured to lock the position of the first segment 72 relative to the position of the second segment 74.

The unlocked position of the articulation 8 is represented in FIG. 5. In the unlocked position, the latch 84 is raised relative to the body of the clevis 80. The first segment 72 is free to move in rotation relative to the second segment 74 through a pivot link.

The locked position of the articulation 8 is represented in FIG. 6. In the locked position, the latch 84 is brought down in contact with the body of the clevis 80. The first segment 72 is held immobile relative to the second segment 74.

With reference to FIG. 7, each vertex 6 comprises a first side wall 61, a second side wall 63, a horizontal wall 65 and an internal wall 67. The walls 61, 63, 65 and 67 form a single-piece wall of the vertex 6.

The side walls 61, 63 and the horizontal wall 65 are orthogonal in pairs and intersect each other. The side walls 61, 61, 63 form side faces of the vertex 6. Each of the side walls 61, 63 has an approximately triangular external surface. The horizontal wall 65 of an upper vertex 6*e*, 6*f*, 6*g*, 6*h* forms an upper ridge wall of the vertex 6. The horizontal wall 65 of a lower vertex 6*a*, 6*b*, 6*c*, 6*d* forms a lower support wall of the vertex 6. The horizontal wall 65 has an approximately triangular external surface.

The internal wall 67 extends perpendicular to the horizontal wall 65. It comprises a first segment 67*a* that extends parallel to the first side wall 61 and a second segment 67*b* that extends parallel to the second side wall 63. Each of the first segment 67*a* and the second segment 67*b* has an approximately triangular external surface.

The internal wall 67 and the first side wall 61 delimit a first internal housing 62. The internal wall 67 and the second side wall 63 delimit a second internal housing 64. This internal wall and the side walls 61, 63 also jointly delimit a central conduit 66 that extends approximately vertically.

The first internal housing 62 forms a cavity open laterally to the exterior of the vertex 6. It is oriented in the plane formed by the height direction X-X and either the transverse direction Z-Z or the depth direction Y-Y. It is configured such that its walls guide one of the segments 72, 74 of a first rod, that is connected to the vertex 6 during its rotation between its extended position and its collapsed position. The triangular external surface of the first segment 67*a* and that of the first side wall 61 also stiffen the corner connection of the articulated reinforcing rod 7 at this vertex 6.

The first internal housing 62 of one of the lower vertices 6*a*, 6*b*, 6*c*, 6*d* is configured such that its walls guide the segment 72, 74 of one of the lower articulated reinforcing rods during its upwards rotation when the frame 3 moves from its extended position to its collapsed position.

With reference for example to the first lower vertex 6*a*, the walls of its first internal housing 62 make the first segment 72*a* of the first articulated reinforcing rod 7*e* pivot upwards, when the frame 3 moves from its extended position to its collapsed position.

The first internal housing 62 of one of the upper vertices 6*e*, 6*f*, 6*g*, 6*h* is configured such that its walls guide the segment 72, 74 of one of the upper articulated rods during its downwards rotation when the frame 3 moves from its extended position to its collapsed position.

With reference for example to the first upper vertex 6*e*, the walls of its first internal housing 62 make the first segment 72*e* of the first upper articulated reinforcing rod 7*e* pivot downwards, when the frame 3 moves from its extended position to its collapsed position.

The second internal housing 64 forms a cavity open laterally to the exterior of the vertex 6. It is oriented in the plane formed by the height direction X-X and either the transverse direction Z-Z or the depth direction Y-Y. It is configured such that its walls guide one of the segments 72, 74 of a second rod, that is connected to the vertex 6 during its rotation between its extended position and its collapsed position. The triangular external surface of the second segment 67*b* and that of the second lateral wall 63 also stiffen the corner connection of the articulated reinforcing rod 7 at this vertex 6.

The second internal housing 64 of one of the lower vertices 6*a*, 6*b*, 6*c*, 6*d* is configured such that its walls guide the segment 72, 74 of one of the lower articulated rods during its upwards rotation when the frame 3 moves from its extended position to its collapsed position.

With reference for example to the first vertex 6*a*, the walls of its second internal housing 64 make the second segment 74*d* of the fourth articulated reinforcing rod 7*d* pivot upwards when the frame 3 moves from its extended position to its collapsed position. The second segment 74*d* of the fourth articulated reinforcing rod 7*d* then moves towards the first segment 72*a* of the first articulated reinforcing rod 7*a*.

The second internal housing 64 of one of the upper vertices 6*e*, 6*f*, 6*g*, 6*h* is configured such that its walls guide the segment 72, 74 of one of the upper articulated rods during its downwards rotation when the frame 3 moves from its extended position to its collapsed position.

With reference for example to the first upper vertex 6*e*, the walls of its second internal housing 64 make the second segment 74*h* of the fourth upper articulated reinforcing rod 7*h* pivot downwards when the frame 3 moves from its extended position to its collapsed position.

The central conduit 66 comprises an internal end piece configured to connect one of the uprights 9 to the vertex 6 by cooperation of shapes, fixing this upright 9 to the corresponding vertex 6. The central conduit 66 houses one of the uprights 9, such that it is rigidly fixed to the vertex 6, when the frame 3 moves from its extended position to its collapsed position and vice versa.

The vertex 6 also comprises position indicators 68 to mechanically connect each articulated reinforcing rod 7 to the vertex 6 with correct positioning. The position indicators 68 are located at the horizontal wall 65.

The movement of the containment airlock 1 from its collapsed storage position to its extended work position is now described with reference to FIGS. 1 to 4.

The intermediate articulations 8 are unlocked.

Each of the lower articulated rods 7*a*, 7*b*, 7*c*, 7*d* is extended downwards, in other words towards the exterior of the frame 3, by pivoting their first segment 72 relative to their second segment 74 by means of their articulation 8. Each first segment 72 pivots relative to the lower vertex 6*a*, 6*b*, 6*c*, 6*d* to which it is connected. Each second segment 74 also pivots relative to the lower vertex 6*a*, 6*b*, 6*c*, 6*d* to which it is connected. In other words, the lower frame 32 is expanded downwards. The uprights 9 and the vertices 6 remain fixed.

Each of the upper articulated rods 7*e*, 7*f*, 7*g*, 7*h* is unfolded upwards, in other words towards the exterior of the frame 3, by pivoting their first segment 72 relative to their second segment 74 by means of their articulation 8. Each first segment 72 pivots relative to the upper vertex 6*e*, 6*f*, 6*g*, 6*h* to which it is connected. Each second segment 74 also pivots relative to the upper vertex 6*e*, 6*f*, 6*g*, 6*h* to which it is connected. In other words, the upper frame 34 is expanded upwards. The uprights 9 and the vertices 6 remain fixed.

Extension of the lower rods 7*a*, 7*b*, 7*c*, 7*d* in the downwards direction and extension of the upper rods 7*e*, 7*f*, 7*g*, 7*h* in the upwards direction take place particularly by moving the uprights 9 away from each other by translation, which causes unfolding of the articulated rods 7*a*, 7*b*, 7*c*, 7*d* 7*e*, 7*f*, 7*g*, 7*h*.

Figure 2:
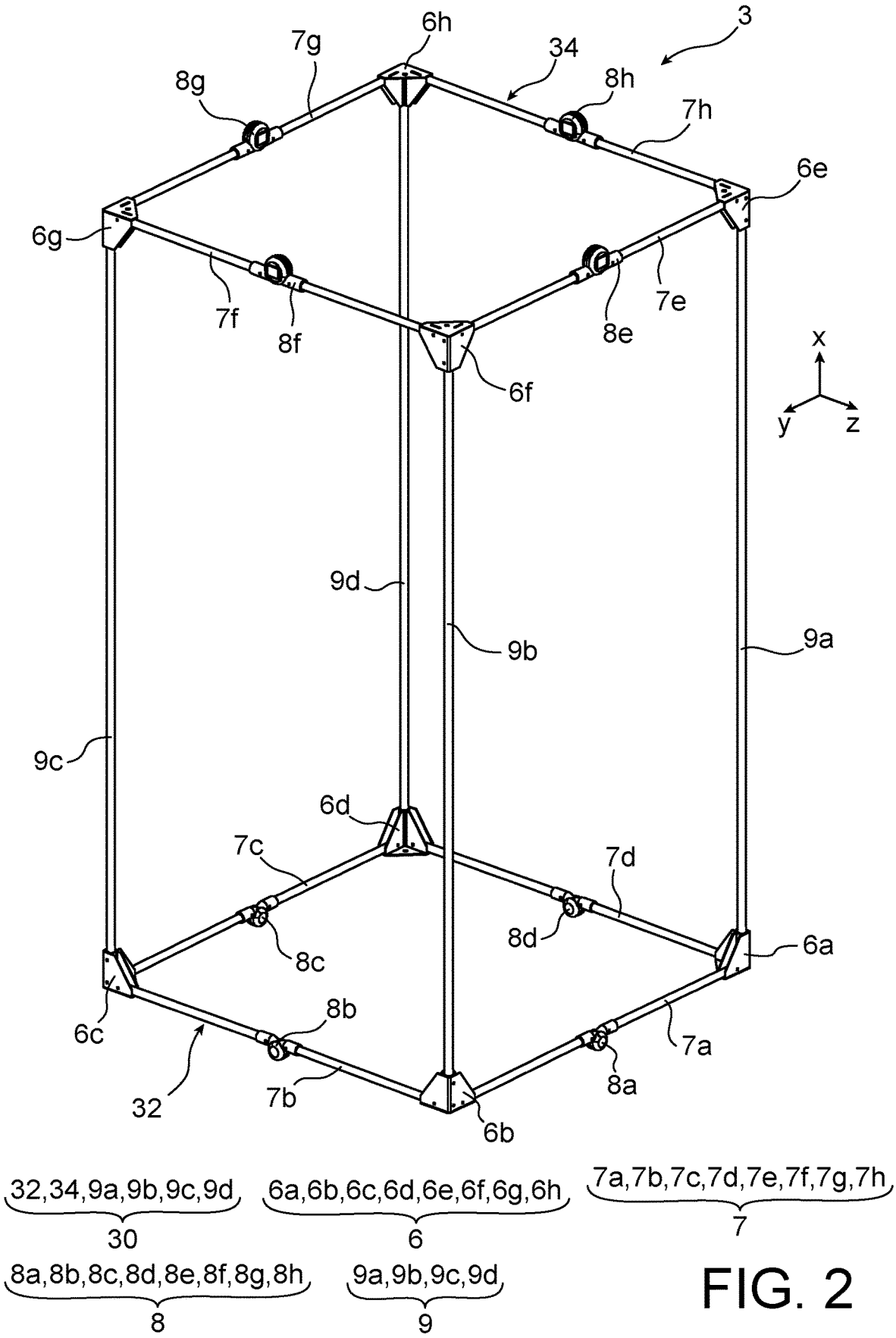
FIG. 2 is a partial diagrammatic perspective representation of the frame of the containment airlock, in the extended position.
Figure 3:
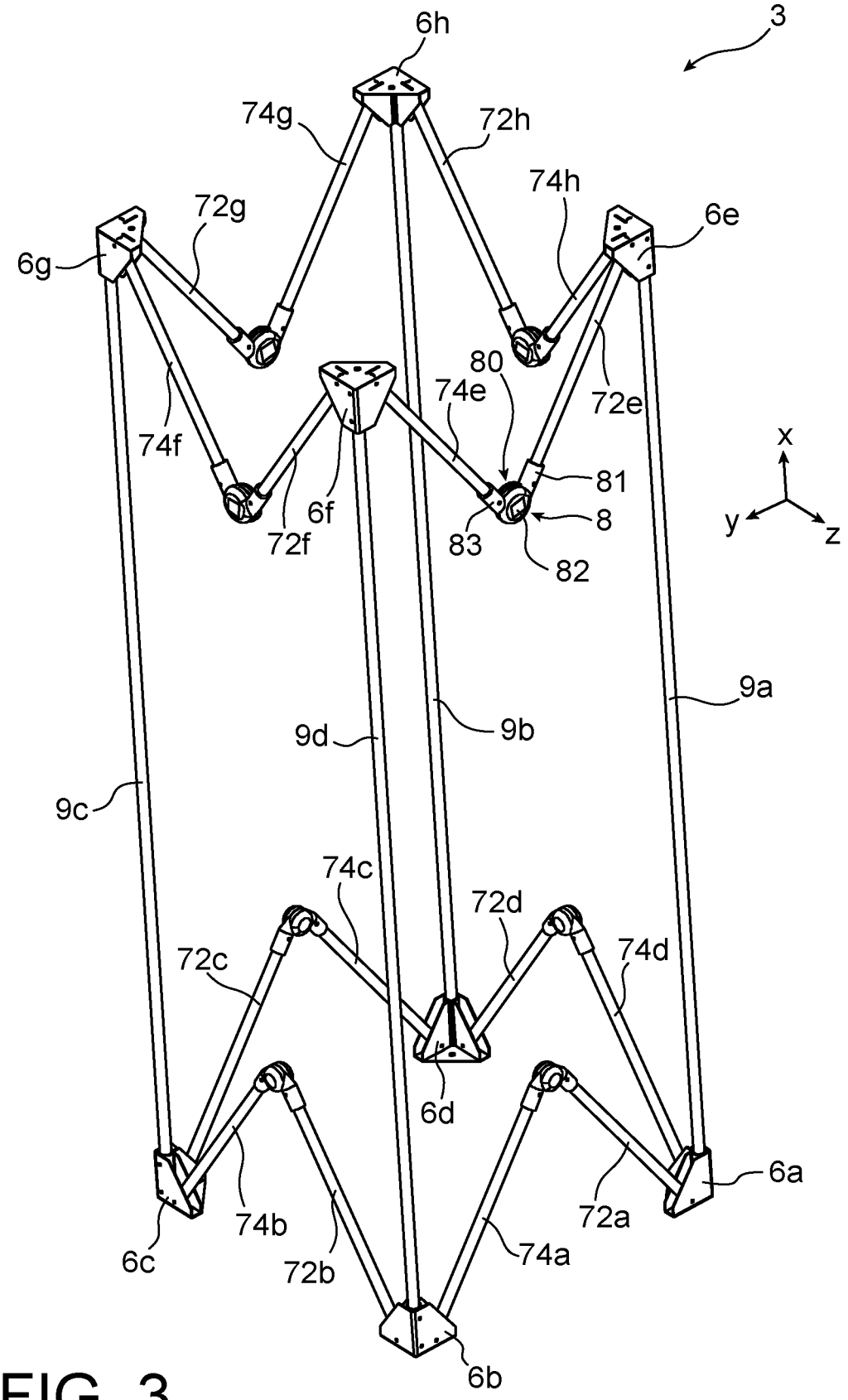
FIG. 3 is a partial diagrammatic perspective representation of the frame of the containment airlock in a position intermediate between its collapsed position and its extended position.

The intermediate articulations 8 are once again locked when the frame is in its extended work position that is shown on FIG. 2.

The shell 5 is attached to the frame 3 by fasteners 56. The depressurisation means are installed on the containment airlock 1.

The movement of the containment airlock 1 from its extended position to its collapsed position, corresponding to the disassembly phase, is now described with reference to FIGS. 1 to 4.

In the case in which the flexible shell 5 was contaminated during the work, the following operations are carried out. Firstly, the opening 51 is closed, as are all openings (if any) that were created for the work, for cable or conduit passages. The hooks 57 are detached from the frame 3 and the depressurisation means are activated so as to draw out air contained in the flexible shell 5 to reduce its volume, and to compact it while maintaining the containment, before it is treated as waste.

If the flexible shell 5 was not contaminated during the work, it remains attached to the frame 3 by means of fasteners 56.

In both cases, regardless of whether or not the frame 3 supports the flexible shell 5, the following operations are performed to collapse the airlock.

The articulations 8 of the articulated reinforcing rods 7 are unlocked by lifting their latch 84.

Each of the lower articulated reinforcing rods 7*a*, 7*b*, 7*c*, 7*d* is collapsed upwards, in other words towards the interior of the frame 3, by pivoting their first segment 72 relative to their second segment 74 by means of their articulation 8.

Each first segment 72 pivots relative to the lower vertex 6*a*, 6*b*, 6*c*, 6*d* to which it is connected. Each second segment 74 also pivots relative to the lower vertex 6*a*, 6*b*, 6*c*, 6*d* to which it is connected. In other words, the lower frame 32 is collapsed upwards. The uprights 9 and the vertices 6 remain fixed.

Each of the upper articulated reinforcing rods 7*e*, 7*f*, 7*g*, 7*h* is collapsed downwards, in other words towards the interior of the frame 3, by pivoting their first segment 72 relative to their second segment 74 by means of their articulation 8. Each first segment 72 pivots relative to the upper vertex 6*e*, 6*f*, 6*g*, 6*h* to which it is connected. Each second segment 74 also pivots relative to the upper vertex 6*e*, 6*f*, 6*g*, 6*h* to which it is connected. In other words, the upper frame 34 is collapsed downwards. The uprights 9 and the vertices 6 remain fixed.

Folding of the lower rods 7*a*, 7*b*, 7*c*, 7*d* in the upwards direction and extension of the upper rods 7*e*, 7*f*, 7*g*, 7*h* in the downwards direction take place particularly by moving the uprights 9 towards each other by translation.

Figure 4:
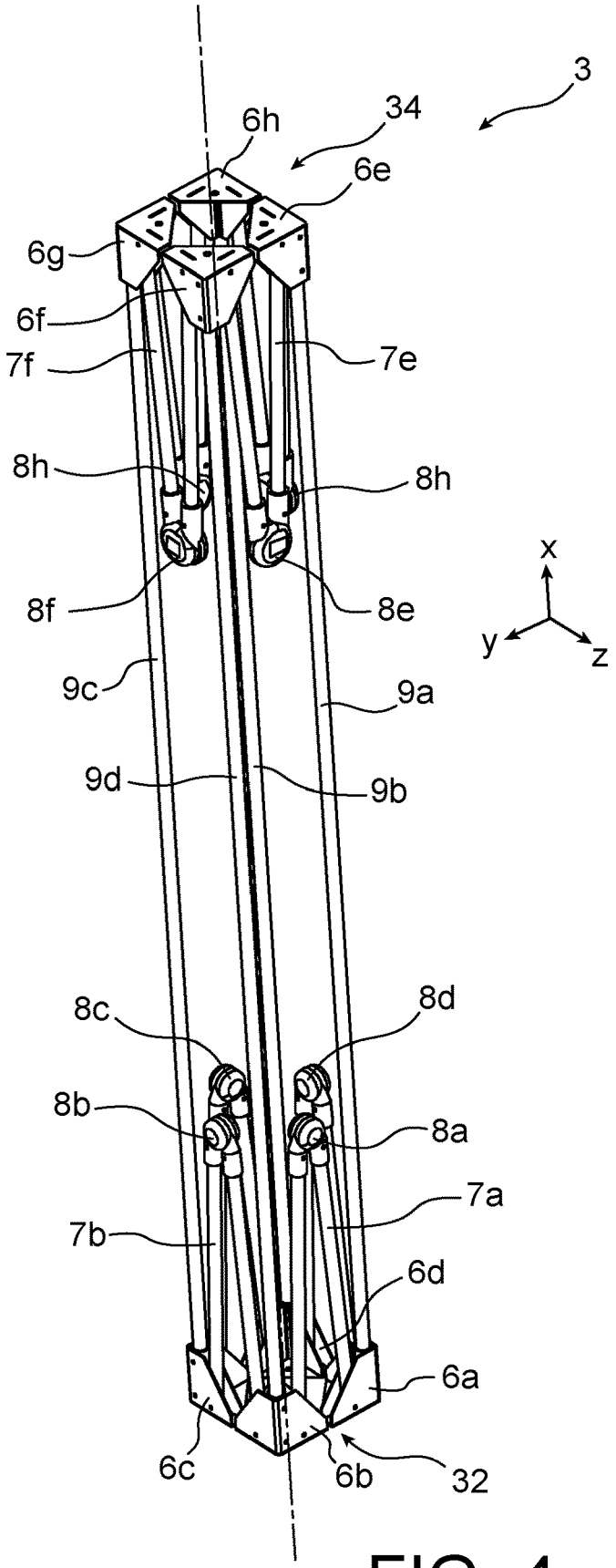
FIG. 4 is a partial diagrammatic perspective representation of the frame of the containment airlock in the collapsed position.

The intermediate articulations 8 are once again locked when the frame is in its collapsed storage position that is shown on FIG. 4.

With reference to FIG. 4, the lower vertices 6*a*, 6*b*, 6*c*, 6*d* have moved towards each other to form a square. They are in contact with each other or are at least at a short distance from each other. The uprights 9*a*, 9*b*, 9*c*, 9*d* also moved towards each other, while remaining parallel to each other. The lower articulated rods 7*a*, 7*b*, 7*c*, 7*d* are collapsed by moving towards the uprights 9*a*, 9*b*, 9*c*, 9*d*. They still connect the lower vertices 6*a*, 6*b*, 6*c*, 6*d* to each other.

The upper vertices 6*e*, 6*f*, 6*g*, 6*h* have moved towards each other to form a square. They are in contact with each other or are at least at a short distance from each other. The upper articulated rods 7*e*, 7*f*, 7*g*, 7*h* are collapsed while moving towards the uprights 9*a*, 9*b*, 9*c*, 9*d*. They still connect the upper vertices 6*e*, 6*f*, 6*g*, 6*h* to each other.

Figure 8:
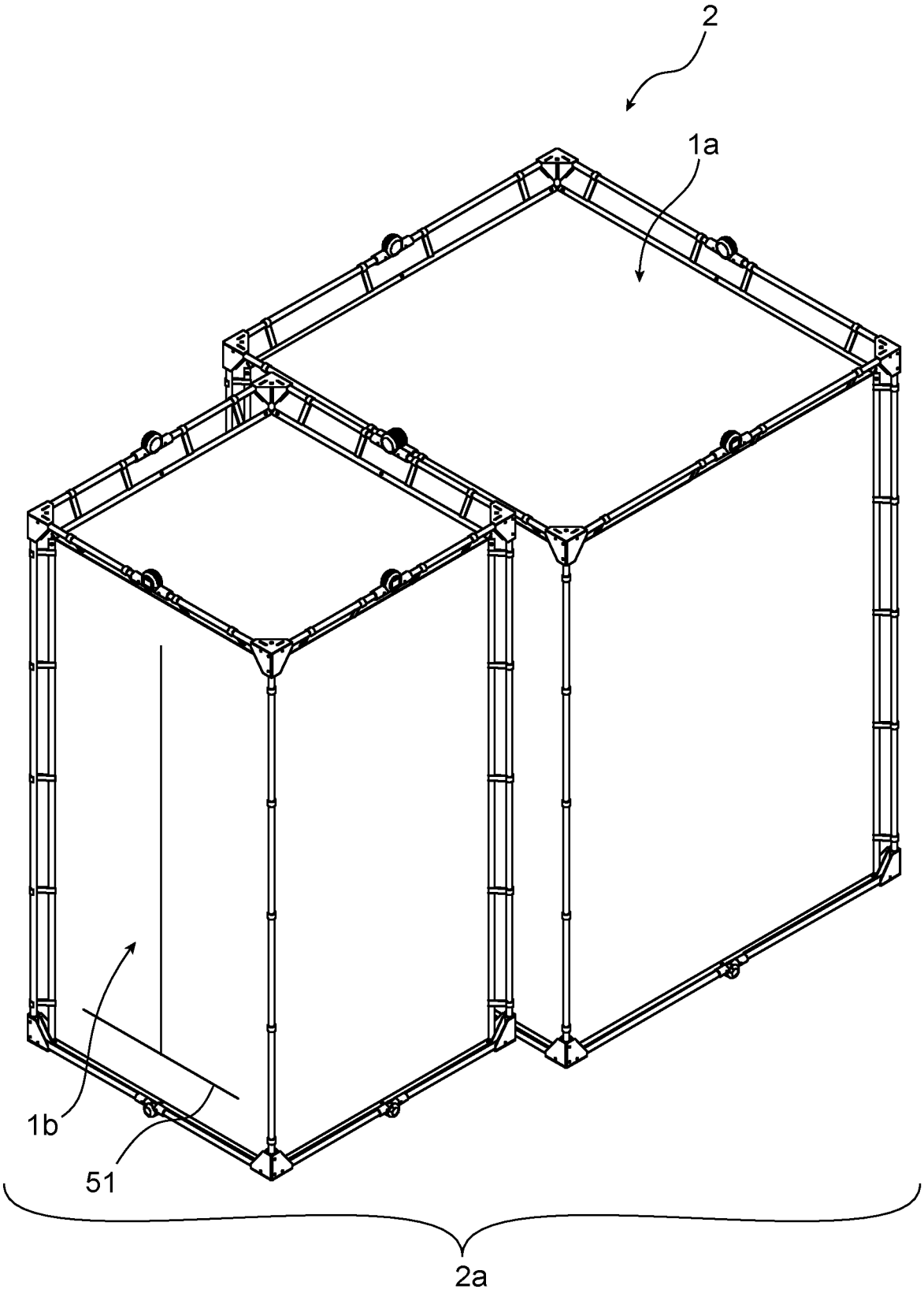
FIG. 8 represents a containment assembly comprising two juxtaposed containment airlocks, according to a first embodiment.

FIG. 8 represents a first containment assembly 2 that comprises a plurality of containment airlocks 1*a*, 1*b*. These containment airlocks 1*a*, 1*b* are adjacent to each other and connected together to form a containment zone 2*a*. The dimensions of the containment airlock 1*a* are twice as large as the dimensions of the containment airlock 1*b*. For example, the airlock 1*b* can form a changing area for operators, after the work done in the area inside airlock 1*a*.

Figure 9:
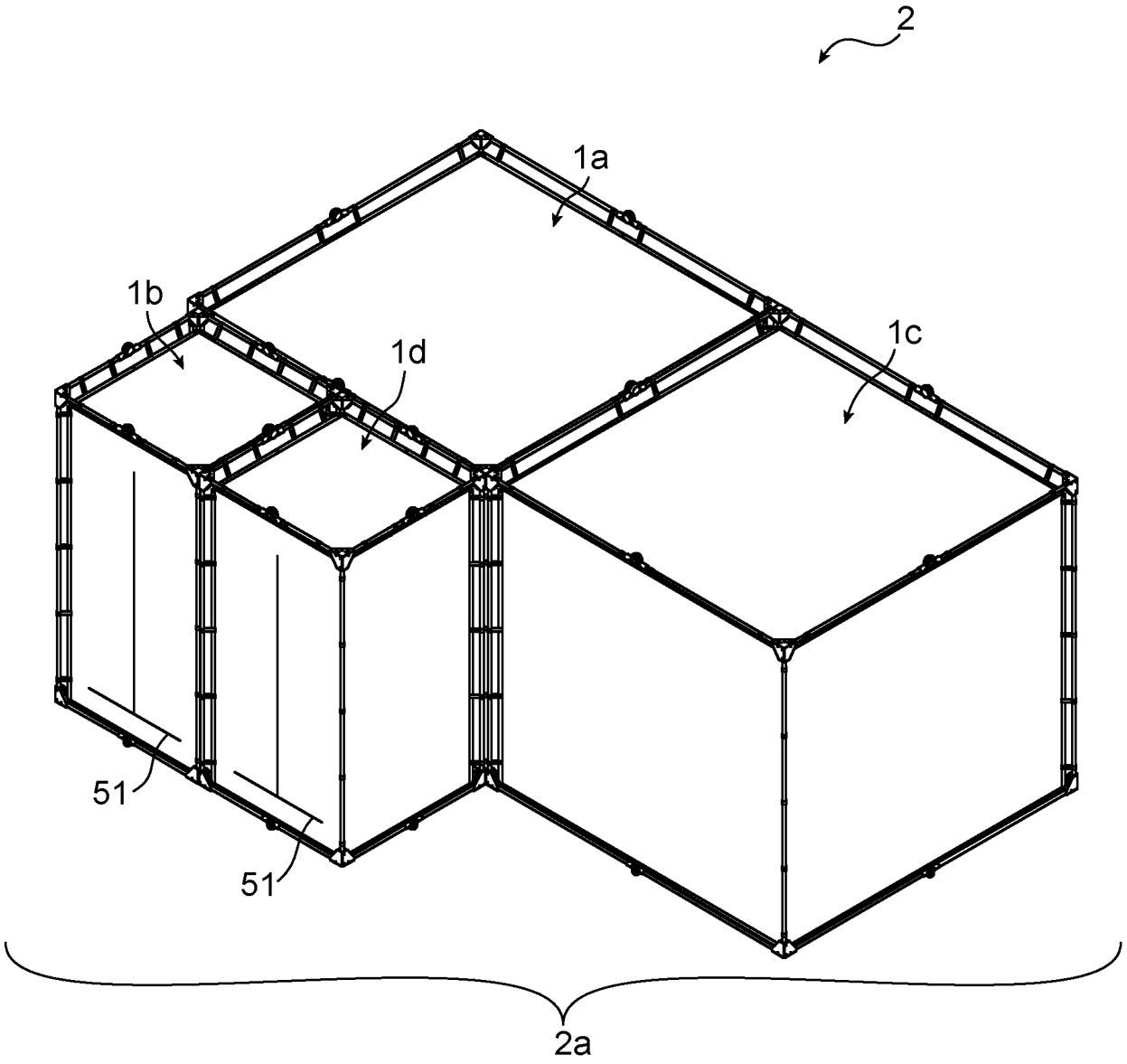
FIG. 9 represents a containment assembly comprising four juxtaposed containment airlocks, according to a second embodiment.

FIG. 9 represents a first containment assembly 2 that comprises a plurality of containment airlocks 1*a*, 1*b*, 1*c*, 1*d* placed adjacent to each other and connected together to form a larger containment area 2*a*. The dimensions of the containment airlocks 1*a* and 1*c* are twice as large as the dimensions of the containment airlocks 1*b* and 1*d*.

The advantage of such an assembly of several standard containment airlocks 1 to each other is to quickly obtain a much larger work area due to the fast assembly of airlocks 1, with the possibility of opening up some of the walls 52 between two airlocks by cutting and sealing the interior of the airlock 1 from the exterior of the airlock 1.

The frame 3 facilitates installation and the removal of the containment airlock 1. The installation and disassembly time of the containment airlock 1 is shortened. It is of the order of 5 to 10 minutes for the installation, while the installation of an airlock with a known structure is typically of the order of 3 to 7 hours depending on the volume of the airlock. Similarly, the disassembly time of the containment airlock 1 is shortened.

The containment airlock 1 thus enables flexibility in the shape and size of the containment zone 2*a* formed by one or several containment airlocks 1 with the same size or different but standard sizes that can be assembled to each other.

The single-piece flexible fabric 50 provides better protection against contamination. In general, the containment airlock 1 can reduce the exposure of operators to the risk of contamination, considering the speed with which it can be disassembled.

Obviously, an expert in the subject can make various modifications to the invention as it has just been described without going outside the plane framework of the presentation of the invention.

The numbers of articulated reinforcing rods 7, rigid single-piece rods 9 and vertices 6 are variable. In particular, the containment airlock 1 can have a shape different from a rectangular parallelepiped, for example it may have a prismatic shape.

According to one variant embodiment (not shown), at least some of the vertices 6 are connected to more than three reinforcing rods 7, 9.

Furthermore, the articulated plane frames 32, 34 can be articulated plane side frames rather than articulated plane horizontal frames. In this case, the single-piece rods 9 extend for example along the transverse direction Z-Z or along the depth direction Y-Y, rather than along the height direction X-X.

The shape and the structure of the articulated rods 7 and single-piece rods 9 can vary. In particular, at least some of the articulated rods 7 and single-piece rods can be formed from solid bars or segments of solid bars.

As a variant and depending on the usage field of the containment airlock 1, the length of the segments 72, 74 and the required thickness of the frame 3, the segments 72, 74 can also be made from carbon or fibreglass.

In particular, the position and the number of articulations 8 in each rod is variable. For example, some rods 7 may comprise at least two articulations and at least three segments. At least some of the articulations 8 can enable a ball-joint connection between segments.

According to one particular embodiment (not shown), only the articulated reinforcing rods 7 of the upper frame 34 are equipped with a locking element 82.

The shape and the structure of the vertices 6 are also variable. In particular, at least one of the vertices 6 is configured to provide a ball-joint type connection at least to one of the segments 72, 74. The vertices 6 may also comprise parts free to move relative to each other or can be single-piece.

The flexible fabric 50 may also comprise a door, composed of a panel 52 of the same material as the fabric welded at the top and positioned to be superposed on the opening 51.

According to one particular embodiment (not shown), the flexible fabric 50 also comprises one or several cuffs to make sealed connections between the interior and the exterior of the containment airlock 1. These cuffs can thus be used for example to position the depressurisation means that will depressurise the airlock, or to introduce the electric cables necessary to supply power for tools to work inside the airlock, or to introduce materials without interrupting the containment.

What is claimed is:

1. A containment airlock for working on a site on which radiological, asbestos, biological and/or chemical contamination occurs, comprising:

a self-supporting frame, the frame being articulated so that it is expandable from a collapsed storage position and an extended work position, a flexible containment shell that is configured to be removably assembled to the frame, wherein the flexible containment shell comprises panels that are each configured to prevent contamination of an interior or an exterior of the containment airlock by radiological, asbestos, biological and/or chemical contamination throughout each panel, and hooks to removably attach the shell to the frame, wherein the hooks suspend the shell inside an internal space defined by the frame when the frame is in the extended work position, wherein the frame comprises a first collapsible plane frame, a second collapsible plane frame, and rigid single-piece reinforcing rods that connect the first collapsible plane frame to the second collapsible plane frame, wherein each of the first collapsible plane frame and the second collapsible plane frame contains vertices of the frame and articulated reinforcing rods that connect the vertices of the first collapsible plane frame to each other and the vertices of the second collapsible plane frame to each other, wherein each of the articulated reinforcing rods comprises a first rigid segment, a second rigid segment and at least one intermediate articulation connecting the first rigid segment to the second rigid segment, wherein the rigid single-piece reinforcing rods connect the vertices of the first collapsible plane frame to the vertices of the second collapsible plane frame, wherein the first collapsible plane frame and the second collapsible plane frame are located at opposite longitudinal ends of the rigid single-piece reinforcing rods, wherein the first collapsible plane frame and the second collapsible plane frame are configured such that the first rigid segment and the second rigid segment of the articulated reinforcing rods move towards the rigid single-piece reinforcing rods when the frame moves from the extended work position to the collapsed storage position, wherein the first collapsible plane frame and the second collapsible plane frame are configured such that the first rigid segment and the second rigid segment of the articulated reinforcing rods move away from the rigid single-piece reinforcing rods when the frame moves from the collapsed storage position to the extended work position, wherein each vertex of the first collapsible plane frame is connected to at least two articulated reinforcing rods so that each side of the first collapsible plane frame collapses when the frame moves from the extended work position to the collapsed storage position, wherein each vertex of the second collapsible plane frame is connected to at least two articulated reinforcing rods so that each side of the second collapsible plane frame collapses when the frame moves from the extended work position to the collapsed storage position, wherein each vertex of the first collapsible plane frame and each vertex of the second collapsible plane frame is configured to guide in rotation the segments of the articulated reinforcing rods relative to the vertex towards the inside of the frame when the frame moves from the extended work position to the collapsed storage position, and wherein each vertex of the first collapsible plane frame and each vertex of the second collapsible plane frame is configured to guide in rotation the segments of the articulated reinforcing rods relative to the vertex towards the outside of the frame when the frame moves from the collapsed storage position to the extended work position.

2. The containment airlock according to claim 1, wherein the intermediate articulation of each articulated reinforcing rod is configured to rotate and to guide the first rigid segment of the reinforcing rod relative to the second rigid segment of the reinforcing rod towards the inside of the frame when the frame moves from the extended work position to the collapsed storage position, and wherein the intermediate articulation of each articulated reinforcing rod is configured to rotate and to guide the first rigid segment of the reinforcing rod relative to the second rigid segment of the reinforcing rod towards the outside of the frame when the frame moves from the collapsed storage position to the extended work position.

3. The containment airlock according to claim 1, wherein the intermediate articulation of each articulated reinforcing rod is located approximately in the middle of the articulated reinforcing rod.

4. The containment airlock according to claim 1, wherein the intermediate articulation of at least one of the articulated reinforcing rods comprises a locking element configured to lock the position of the first rigid segment of the reinforcing rod relative to the position of the second rigid segment of the reinforcing rod.

5. The containment airlock according to claim 4, wherein the intermediate articulation comprises a clevis and wherein the locking element comprises a latch that is free to move relative to the clevis between a locked position and an unlocked position of the articulation.

6. The containment airlock according to claim 1, wherein the intermediate articulation of each articulated reinforcing rod is configured to rotate and to guide the first rigid segment of the reinforcing rod relative to the second rigid segment of the reinforcing rod about a pivot link, and wherein at least one of the vertices is configured to rotate and to guide the first rigid segment of the articulated reinforcing rod relative to the vertex about a pivot link.

7. The containment airlock according to claim 1, wherein at least one of the vertices comprises a housing to partially house the first rigid segment of the articulated reinforcing rod, wherein the housing is at least partially delimited by walls configured to make the first rigid segment pivot relative to the vertex when the frame moves from the extended work position to the collapsed storage position, and wherein the housing is at least partially delimited by walls configured to make the first rigid segment pivot relative to the vertex from the collapsed storage position to the extended work position.

8. The containment airlock according to claim 1, wherein at least one of the vertices comprises an internal end piece configured to engage by cooperation of shapes at least one segment of the articulated reinforcing rod connected to the vertex.

9. The containment airlock according to claim 1, wherein at least one of the vertices comprises at least one first side wall, a second side wall, a horizontal wall and an internal wall, wherein the first side wall, the second side wall and the horizontal wall are orthogonal in pairs and intersecting each other, wherein the internal wall extends perpendicular to the horizontal wall, wherein each of the side walls has an approximately triangular external surface, wherein the internal wall comprises a first segment that extends parallel to the first lateral wall and a second segment that extends parallel to the second lateral wall, each of the first segment and the second segment having an approximately triangular external surface, wherein the internal wall and the first side wall delimit a first internal housing for the first segment or the second segment of the articulated reinforcing rod, wherein the internal wall and the second side wall delimit a second internal housing for the first segment or the second segment of another articulated reinforcing rod, wherein the internal wall and the side walls delimit a central conduit for one of the rigid single-piece reinforcing rods.

10. The containment airlock according to claim 1, wherein the first collapsible plane frame is a horizontal plane support frame, wherein the second collapsible plane frame is a horizontal plane top frame, wherein the rigid single-piece reinforcing rods is the uprights of the frame.

11. The containment airlock according to claim 10, wherein the containment airlock has a generally parallelepiped shape when the frame is in the extended work position.

12. The containment airlock according to claim 11, wherein the containment airlock has a generally parallelepiped shape when the frame is in the collapsed storage position.

13. The containment airlock according to claim 1, wherein the shell is made of a dust tight material.

14. The containment airlock according to claim 1, wherein the shell is made of a single-piece by welded plastic panels.

15. The containment airlock according to claim 1, wherein the shell is made of a plastic material comprising cross-linked polyurethane and/or a vinyl polymer, such as polyvinyl chloride.

16. The containment airlock according to claim 1, comprising depressurisation means configured to create a vacuum inside the airlock, relative to the air pressure outside the airlock.

17. A containment assembly comprising a plurality of containment airlocks according to claim 1 that are adjacent to each other and connected together, to form a containment zone, particular to protect against radiological, asbestos, biological and/or chemical contamination.

* * * * *